United States Patent [19]

Fujigaya et al.

[11] Patent Number: 4,721,071

[45] Date of Patent: Jan. 26, 1988

[54] COOLING SYSTEM FOR AUTOMOTIVE ENGINE OR THE LIKE

[75] Inventors: Kazuyuki Fujigaya, Yokosuka; Yoshinori Hirano, Yokohama; Hitoshi Shimonosono, Yokosuka, all of Japan

[73] Assignee: Nissan Motor Co., Ltd., Yokohama, Japan

[21] Appl. No.: 918,052

[22] Filed: Oct. 14, 1986

[30] Foreign Application Priority Data

| | | | |
|---|---|---|---|
| Oct. 15, 1985 | [JP] | Japan | 60-157563[U] |
| Oct. 23, 1985 | [JP] | Japan | 60-235428 |
| Mar. 25, 1986 | [JP] | Japan | 61-66790 |
| Apr. 4, 1986 | [JP] | Japan | 61-77843 |
| Apr. 4, 1986 | [JP] | Japan | 61-77844 |

[51] Int. Cl.[4] ..... F01P 3/22

[52] U.S. Cl. ..... 123/41.21; 123/41.27

[58] Field of Search ..... 123/41.2–41.27; 165/104.27, 104.32

[56] References Cited

U.S. PATENT DOCUMENTS

| | | | |
|---|---|---|---|
| 1,787,562 | 1/1929 | Barlow | 123/41.03 |
| 3,981,279 | 9/1976 | Bubniak et al. | 123/41.14 |
| 4,352,342 | 10/1982 | Cser et al. | 123/41.29 |
| 4,367,699 | 1/1983 | Evans | 123/41.23 |
| 4,563,983 | 1/1986 | Hayashi et al. | 123/41.27 |
| 4,572,115 | 2/1986 | Hayashi | 123/41.21 |
| 4,616,601 | 10/1986 | Hayashi | 123/41.27 |
| 4,656,974 | 4/1987 | Hayashi | 123/41.27 |
| 4,658,763 | 4/1987 | Hayashi | 123/41.21 |
| 4,662,317 | 5/1987 | Ogawa | 123/41.21 |

*Primary Examiner*—William A. Cuchinski, Jr.

*Attorney, Agent, or Firm*—Schwartz, Jeffery, Schwaab, Mack, Blumenthal & Evans

[57] ABSTRACT

A reservoir in which coolant is stored, is fluidly interposed between the downstream end of the condensor in which coolant vapor from the engine coolant jacket is condensed, and a coolant return pump which is responsive to a level sensor disposed in the coolant jacket, in a manner to form part of the cooling circuit of the system. The system further includes two temperature sensors, the first is disposed in the lower tank of the radiator and the other in the coolant jacket proximate the cylinder head. A device which modifies the pressure prevailing in the system is operated in response to one or both of the temperature sensors. This device can take the form of a cooling fan or an electromagnetic valve which controls one of a coolant jacket/atmosphere vent or a reservoir/atmosphere vent.

23 Claims, 15 Drawing Figures

COOLING SYSTEM FOR AUTOMOTIVE ENGINE OR THE LIKE

BACKGROUND OF THE INVENTION

1. Field of the Invention

The present invention relates generally to an evaporative type cooling system for an internal combustion engine wherein liquid coolant is permitted to boil and the vapor used as a vehicle for removing heat therefrom, and more specifically to such a system which does not require any electromagnetic valves to effect the required coolant control whereby rusting of the interior of the coolant jacket, radiator and associated elements when the engine is not in use due to exposure to atmospheric oxygen is prevented and which when equipped with a single electromagnetic valve enables very quick warm-up when the engine is subject to cold starts or an increase in radiator heat exchange efficiency.

2. Description of the Prior Art

In currently used "water cooled" internal combustion engines (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the required amount of heat.

Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having an 1800 cc displacement (by way of example) is operated full throttle, the cooling system is required to remove approximately 4000 Kcal/h. In order to achieve this, a flow rate of approximately 167 liter/min must be produced by the water pump. This of course undesirably consumes several horsepower produced by the engine.

FIG. 2 shows an arrangement disclosed in Japanese Patent Application Second Provisional Publication Sho. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement while eliminating the power consuming coolant circulation pump which plagues the above mentioned arragement, has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency. Further, with this system in order to maintain the pressure within the coolant jacket and radiator at atmospheric level, a gas permeable water shedding filter 5 is arranged as shown, to permit the entry of air into and out of the system.

However, this filter permits gaseous coolant to readily escape from the system, inducing the need for frequent topping up of the coolant level. A further problem with this arrangement has come in that some of the air, which is sucked into the cooling system as the engine cools, tends to dissolve in the water, whereby upon start up of the engine, the dissolved air tends to come out of solution and forms small bubbles in theradiator which adhere to the walls thereof and form an insulating layer. The undissolved air also tends to collect in the upper section of the radiator and inhibit the convection-like circulation of the vapor from the cylinder block to the radiator. This of course further deteriorates the performance of the device.

When the engine is not in use the air which is permitted into the system via the air-permeable filter tends to induce rapid corrosion of the parts thereof not immersed in liquid coolant due to exposure to atmospheric oxygen. Viz., as the system is not completely filled with coolant as in the case of the circulation type systems such as shown in FIG. 1, the addition of anti-corrosion agents to the coolant cannot prevent rapid deterioration of the exposed sections of the radiator and the like.

European Patent Application Provisional Publication No. 0 059 423 published on Sept. 8, 1982 discloses another arrangement wherein, liquid coolant in the coolant jacket of the engine, is not forcefully circulalted therein and permitted to absorb heat to the point of boiling. The gaseous coolant thus generted is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve. This arrangement has suffered from the drawback that when the engine is stopped and cools down the coolant vapor condenses and induces sub-atmospheric conditions which tend to induce air to leak into the system. This air tends to be forced by the compressor along with the gaseous coolant into the radiator.

Due to the difference in specific gravity, the above mentioned air tends to rise in the hot environment while the coolant which has condensed moves downwardly. The air, due to this inherent tendency to rise, tends to form pockets of air which cause a kind of "embolism" in the radiator and which badly impair the heat exchange ability thereof.

FIG. 3 shows an evaporative type cooling system described in U.S. Pat. No. 4,367,699 issued on Jan. 11, 1983 in the name of Evans. This arrangement features a separation tank 6 wherein gaseous and liquid coolant are initially separated. The liquid coolant is fed back to the cylinder block 7 under the influence of gravity while the relatively dry gaseous coolant (steam for example) is condensed in a fan cooled radiator 8.

The temperature in the radiator is controlled to a predetermined constant level by selective energizations of the fan 9 which maintains a rate of condensation therein sufficient to provide a liquid seal at the bottom of the device. Condensate discharged from the radiator via the above mentioned liquid seal is collected in a small reservoir-like arrangement 10 and pumped back up to the separation tank via a small constantly energizedpump 11.

This arrangement, while providing means via which air can be initially purged to some degree from the system tends to, due to the nature of the arrangement which permits said initial non-condensible matter to be forced out of the system, suffers from rapid loss of coolant when operated at relatively high altitudes. Further, once the engine cools air is relatively freely admitted back into the system. The provision of the bulky separation tank 6 also renders engine layout difficult and induces the additional problem that the level of coolant in the coolant jacket cannot be stably maintained under all modes of the engine operation.

Further, when the engine is stopped or "shut-down", as the condensor is completely drained of coolant and filled with atmospheric air and the level of coolant in the separation tank lowered, the interior of the condensor, separation tank and conduiting etc., are subject to rapid corrosion due to exposure to the oxygen in the air. This corrosion tends to rapidly reduce the usable life of the system and requires troublesome and expensive parts replacement from time to time. The addition of anti-corrosion agents to the coolant does not alleviate the problem.

Japanese Patent Application First Provisional Publication No. sho. 56-32026 (FIG. 4) discloses an arrangement wherein the structure defining the cylinder head and cylinder liners are covered in a porous layer of ceramic material 12 and wherein coolant is sprayed into the cylinder block from shower-like arrangements 13 located above the cylinder heads 14. The interior of the coolant jacket defined within the engine proper is essentially filled with gaseous coolant during engine operation at which time liquid coolant sprayed onto the ceramic layers 12.

However, this arrangement has proven totally unsatisfactory in that upon boiling of the liquid coolant absorbed into the ceramic layers, the vapor thus produced and which escapes toward and into the coolant jacket, inhibits the penetration of fresh liquid coolant into the layers and induces the situation wherein rapid overheat and thermal damage of the ceramic layers 12 and/or engine soon results. Further, this arrangement is of the closed circuit type and is plagued with air contamination and blockages in the radiator similar to the compressor equipped arrangement discussed above.

FIG. 5 shows an arrangement disclosed in U.S. Pat. No. 1,787,562 published on Jan. 6, 1931 in the name of L. P. Barlow. In this arrangement the coolant vapor which is condensed in the radiator 16 is first collectd in the lower tank 17 of the radiator 16 and then transferred to the a larger reservoir 18 located below the same and returned to the coolant jacket 20 via a pump 22 which is controlled by a float type level sensor arrangement 23 located in the upper section of the coolant jacket 20.

The pump 22 communicates with the coolant jacket 20 via a conduit 24 which is formed with a U-bend 25. This bend limits the amount of coolant which can drain back through the conduit 24 toward the reservoir 18. The interior of the radiator 16 and the reservoir 18 are both vented to the atmosphere via a conduit 26 and vent port 27 arrangement which fluidly interconnects the top of the reservoir 18 with lower tank 17 of the radiator.

Accordingly, this arrangement also suffers from the problem that, during non-use, the interior of the radiator 16 and the upper section of the engine coolant jacket 20 are constantly exposed to atmospheric oxygen and accordingly prone to undergo rapid rusting and the like deterioration.

A further drawback encountered with this device comes in that the cooling fan 28 is constantly driven by the engine and not controlled in response to the amount of heat produced by the engine and thus apt to consume unecessary energy.

FIG. 6 shows an arrangement which is disclosed in U.S. Pat. No. 4,549,505 issued on Oct. 29, 1985 in the name of Hirano. The disclosure of this application is hereby incorporated by reference thereto. For convenience the same numerals as used in the above mentioned Patent are also used in FIG. 6.

However, this arrangement while solving man of the drawbacks encountered with the previously disclosed prior art by completely filling the interior of the coolant jacket, radiator and associated conduiting, which define a closed loop cooling circuit, with liquid coolant when the engine is not in use and effecting steps which purge any air which may leak in with the passing of time or during modes of operation when the pressure in the cooling circuit is rendered subatmospheric; has itself suffered from the drawbacks that it requires no less than four electromagnetic valves and a highly complex control circuit (in this case a microprocessor) to enable the required coolant management to be effected. This, while permitting the variation of the temperature at which the coolant boils with respect to the instant engine speed and load, notably increases the complexity and cost of the system.

Further, in the event that one of the valves or the control circuit malfunctions the operablity of the whole system is placed in jeopardy and is likely to result in engine damage or temporary inoperablity.

Further, with this system the possibilty exists that after prolonged high speed/high load engine operation and/or operation in hot environments, the system is subject to a thermal saturation phenomenon wherein the all of the limited amount of coolant retained in the closed loop cooling circuit (excluding that in the coolant jacket) is close to boiling. This induces pump cavitation problems wherein the coolant when subject to a pressure reduction within the pump, boils producing sufficient coolant vapor to vapor lock the pump and temporarily inhibit the maintainance of the critical coolant level in the coolant jacket.

A similar pump caviation problem is sometimes encountered when, in order to maximize the heat exchange capacity of the radiator, the level of liquid coolant therein is minimized and the vehicle in which the system is disposed is subject to a lateral acceleration (eg. high speed cornering) which can cause the low level of coolant in the lower tank at the bottom of the radiator to slant sufficiently that coolant vapor is permitted to be fed directly to the induction port of the coolant return pump.

SUMMARY OF THE INVENTION

It is an object of the present invention to provide a structurally simple evaporative cooling system which does not require any electromagnetic valves to effect the coolant management which enables the complete filling and thus the prevention of rusting of the interior of the coolant jacket, radiator and associated elements when the engine is not in use due to exposure to atmospheric oxygen, and which when equipped with only a single electromagnetic valve enables either very quick warm-up when the engine is subject to cold starts or increased radiator heat exchange efficiency.

In brief, the above object is achieved via the use of a basic arrangement wherein a reservoir in which coolant is stored, is fluidly interposed between the downstream end of the condensor in which coolant vapor from the engine coolant jacket is condensed, and a coolant return pump which is responsive to a level sensor disposed in the coolant jacket, in a manner to form part of the cooling circuit of the system. The system further include two temperature sensors, the first is disposed in the lower tank of the radiator and the other in the coolant jacket proximate the cylinder head. A device which modifies the pressure prevailing in the system is operated in response to one or both of the temperature sensors. Viz., the operation of a fan associated with the radiator is controlled in response to either the temperature sensor which is disposed in the lower tank alone or in response to both. In the latter instance the temperature difference between the coolant jacket and the lower tank is used to approximate how full the radiator is of liquid coolant and thus whether the operation of the fan is warrented or not.

Alternatively, or in combination with the above, a single electromagnetic valve which is responsive to the second temperature sensor alone is use to control a coolant jacket/atmosphere vent in a manner to permit some of the coolant which fills the coolant jacket when the engine is not in use, to be drained rapidly therefrom at engine start-up to reduce warm-up time. In a another embodiment a similar valve can be used to control a reservoir/atmosphere vent and enable the pressure in the system to be selectively raised in order to improve the heat exchange efficiency of the radiator. In this case the valve is arranged to responsive to both of the temperature sensors.

More specifically, a first aspect of the the present invention takes the form of an internal combustion engine having a structure subject to high heat flux and which is characterized by a cooling system comprising: a coolant jacket disposed about the structure and into which coolant is introduced in liquid form, permitted to boil and discharged in gaseous form; a radiator in fluid commuication with the coolant jacket which receives coolant vapor produced therein and condenses it to its liquid form, the radiator including a small collection vessel disposed at the bottom thereof; a reservoir in which coolant is stored, the reservoir being fluidly interposed between the collection vessel of the radiator and the coolant jacket; a level sensor disposed in the coolant jacket, the level sensor being arranged to sense the level of liquid coolant in the coolant jacket falling below a predetermined level and issues a signal indicative thereof, the predetermined level being selected to be such that the structure subject to high heat flux is immersed in a predetermined depth of liquid coolant; a pump which pumps liquid coolant from the reservoir to the coolant jacket through a coolant return conduit, the pump being responsive to the level sensor in a manner to maintain the level of liquid in the coolant jacket at the predetermined level; a first temperature sensor disposed in the radiator; a second temperature sensor disposed in the coolant jacket; and a device associated with one of the radiator, the coolant jacket and the reservoir, the device being responsive to at least one of the first and second temperature sensors for controlling the pressure within the cooling system.

A second aspect of the present invention comes in the form of a method of cooling an internal engine which is characterized by the steps of: introducing liquid coolant into a coolant jacket, permitting the coolant to boil and discharging the coolant in vaporized form; condensing the coolant vapor discharged from the coolant jacket in a radiator to form a condensate; storing liquid coolant in a reservoir; returning the condensate formed in the radiator to the reservoir; sensing the level of coolant in the coolant jacket using a level sensor; pumping liquid coolant from the reservoir to the coolant jacket in response to the level sensing step indicating that the level of liquid coolant in the coolant jacket is below a predetermined level; sensing the temperature of the condensate formed in the radiator; sensing the temperature of the coolant in the coolant jacket; and controlling a device associated with one of the radiator, the coolant jacket and the reservoir in a manner which controls the pressure prevailing within the cooling system.

DETAILED DESCRIPTION OF THE PREFERRED EMBODIMENTS

Figure 1:
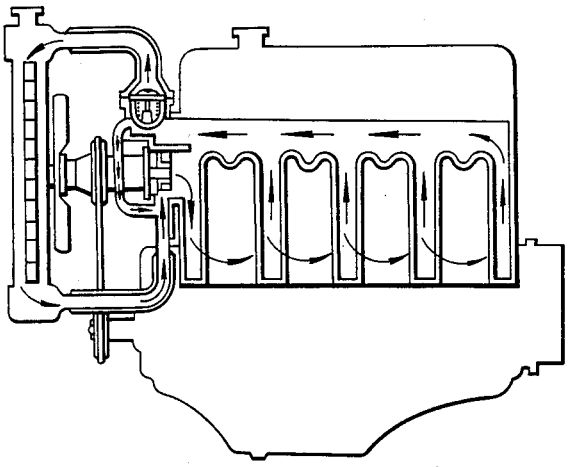
FIG. 1 (PRIOR ART)
FIGS. 1 to 5 show the prior art arrangements discussed in the opening paragraphs of the instant disclosure.
Figure 2:
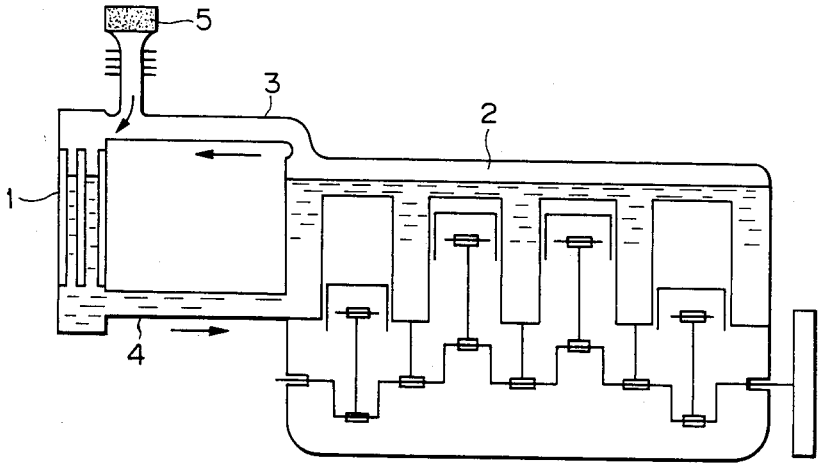
FIG. 2 (PRIOR ART)
Figure 3:
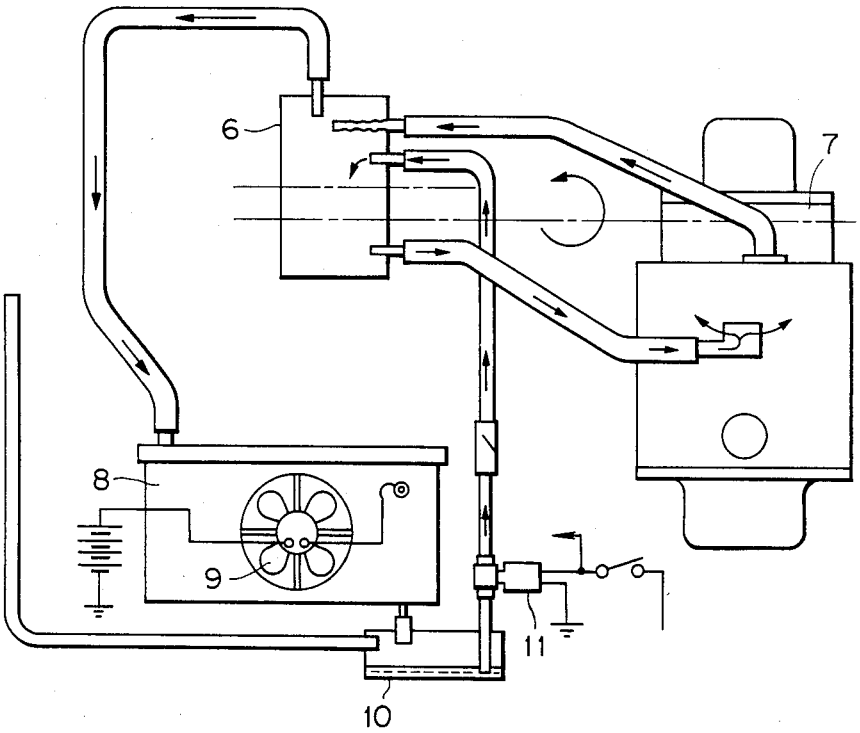
FIG.3 (PRIOR ART)
Figure 4:
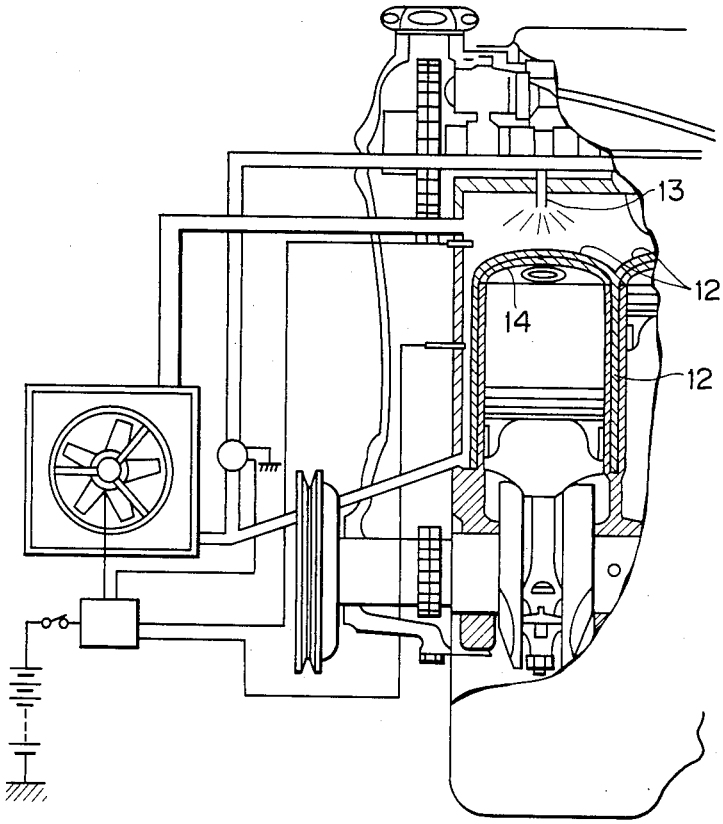
FIG. 4 (PRIOR ART)
Figure 5:
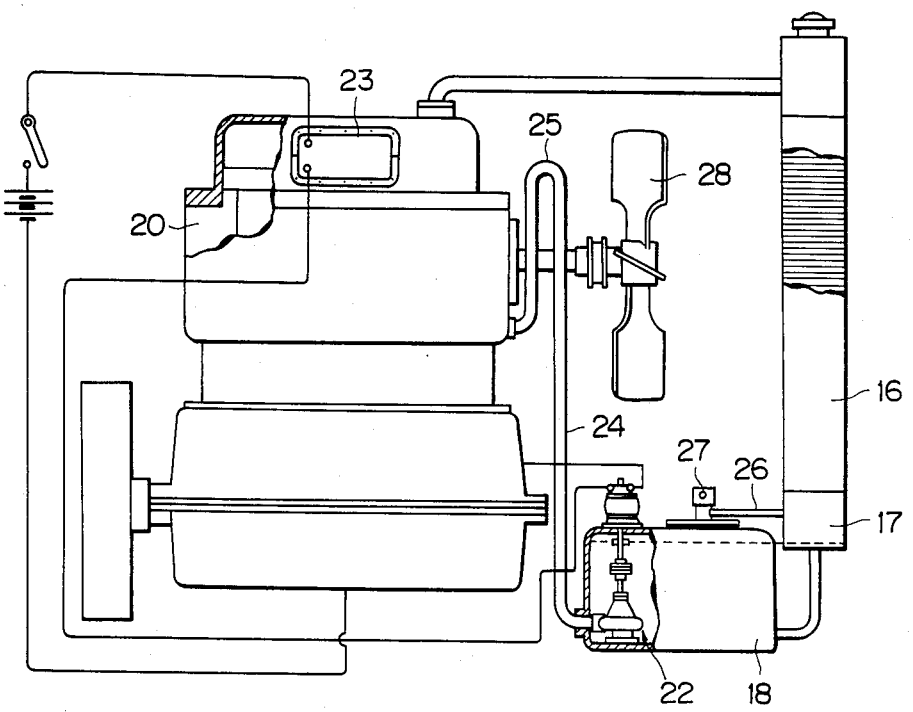
FIG. 5 (PRIOR ART)
Figure 6:
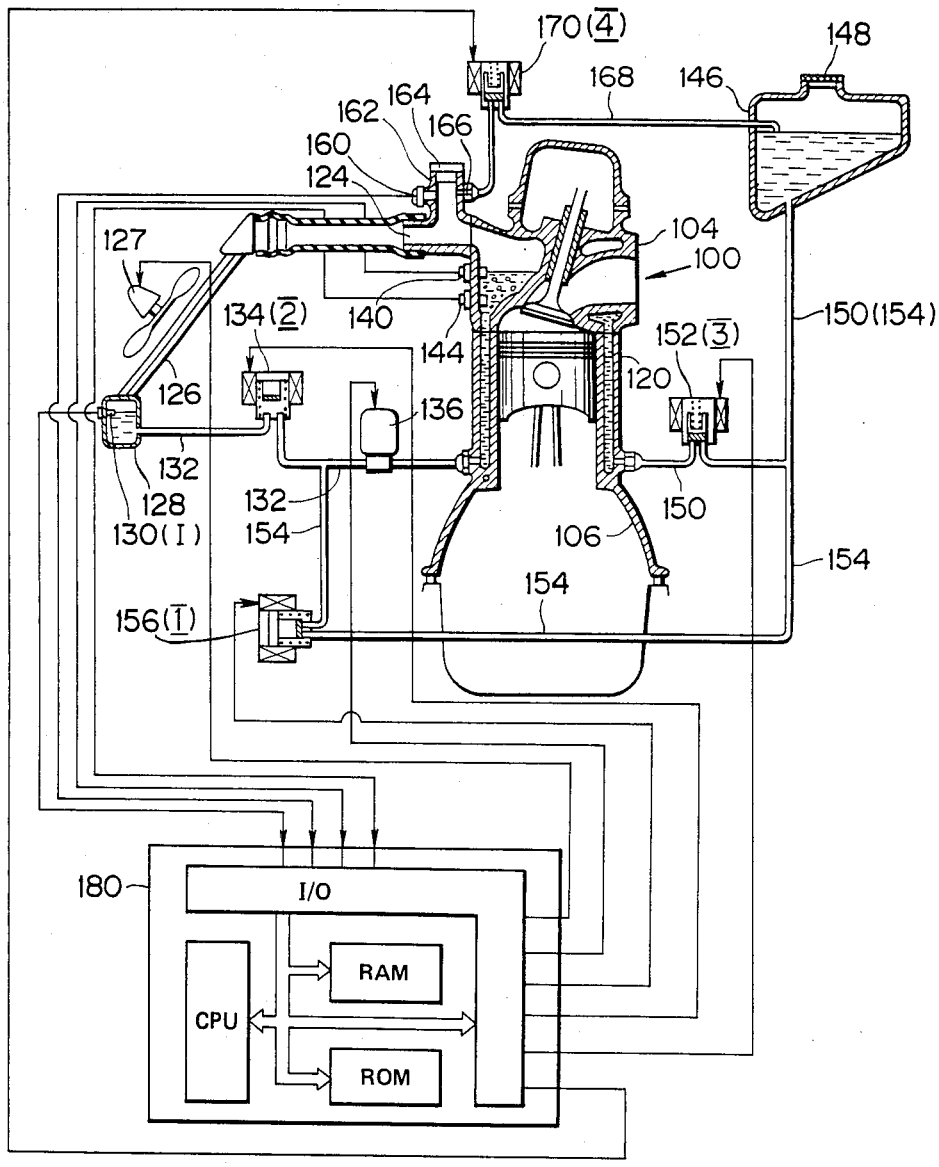
FIG. 6 is a schematic elevation showing the arrangement disclosed in the opening paragraphs of the instant disclosure in conjunction with U.S. Pat. No. 4,549,505.
Figure 7:
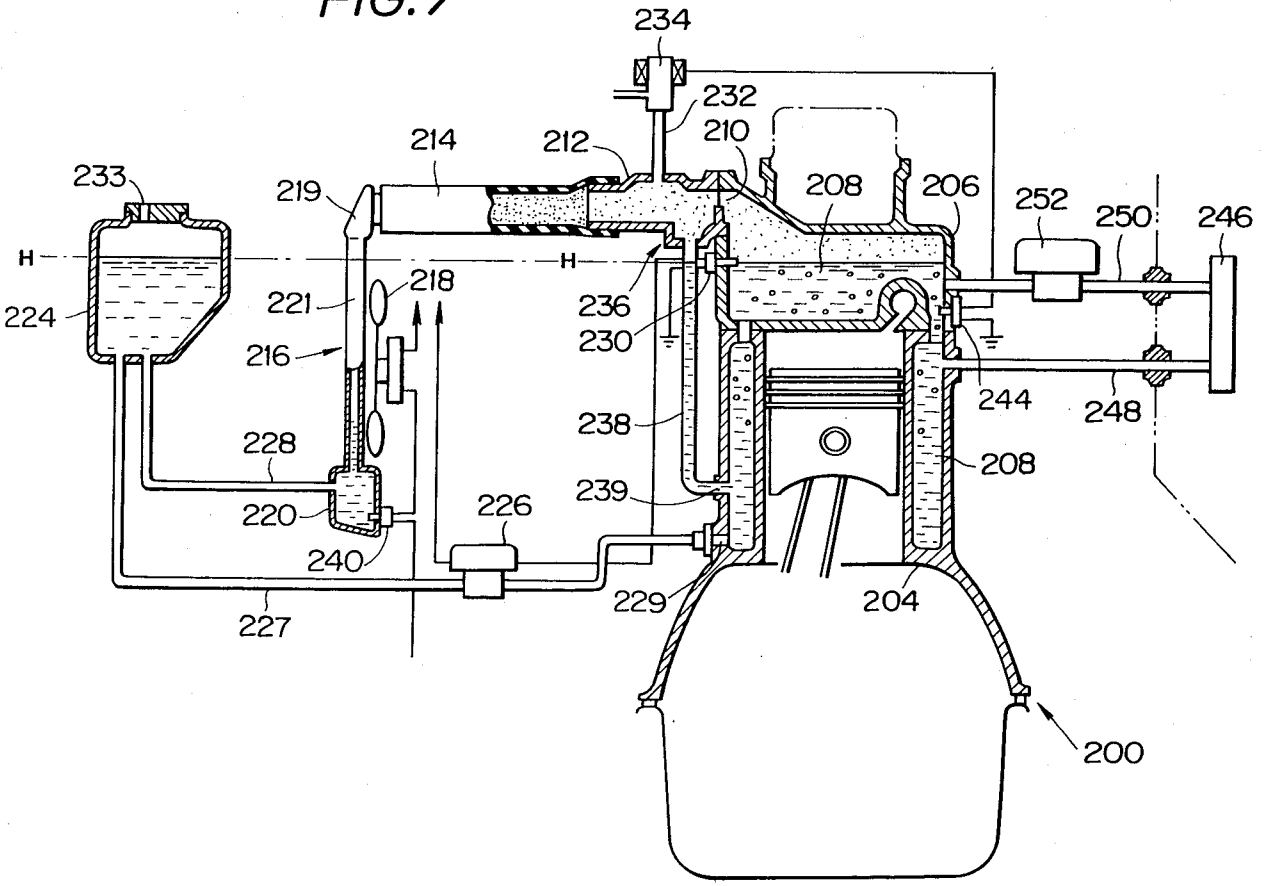
FIGS. 7 to 9 are schematic elevations of engine cooling systems to which first, second & fourth, and third & fifth emboidments of the present invention are respectively applied.

FIG. 7 of the drawings shows an engine system to which a first embodiment of the invention is applied. In this arrangement an internal combustion engine 200 includes a cylinder block 204 on which a cylinder head 206 is detachably secured. The cylinder head and block are formed with suitably cavities which define a coolant jacket 208 about structure of the engine subject to high heat flux (e.g. combustion chambers exhaust valves conduits, cylinder walls etc.,).

Fluidly communicating with a vapor discharge port 210 formed in the cylinder head 206 via a vapor manifold 212 and vapor conduit 214, is a condensor 216 or radiator as it will be referred to hereinafter. Located adjacent the radiator 216 is a selectively energizable electrically driven fan 218 which is arranged to induce a cooling draft of air to pass over the heat exchanging surfaces of the radiator 216 upon being put into operation.

In order to take full advantage of the natural draft of air which occurs when a vehicle moves along a road or the like, and to minimize the need to operate fan 218, the radiator 216 is preferably disposed at a well ventilated location such as near the front of the vehicle.

Radiator 216 in this embodiment takes the form of upper and lower tanks 219, 220 which span the width of the device and a plurality relatively small diameter vertically extending tubes 221 interconnecting the same. In this instance the lower tank 220 is formed in a manner to have a larger internal volume than the upper one and thus function as a small collection reservoir or vessel.

A coolant reservoir 224 is arranged to constantly communicate with the the lower tank 220 via a supply/-discharge conduit 228. The reservoir 224 is closed by a cap in which an air bleed or vent 233 is formed. This permits the interior of the reservoir 224 to be maintained constantly at atmospheric pressure.

In this embodiment reservoir 224 is arranged with respect to the coolant jacket so that under given modes of engine operation it is possible, by rendering the cooling jacket open to the ambient atmosphere and utilizing gravity, to bring about the situation wherein the level of coolant in the coolant jacket 208 and that in the reservoir 224 become equal at approximately a predetermined level "H". The reason for this particular arrangement will become clear hereinlater.

A small capacity electrically driven pump 226 is disposed in a coolant return conduit 227 which leads from the reservoir 224 to an inlet port 229 formed at the bottom of the section of the coolant jacket formed in the cylinder block 204. The capacity of this pump 226 is selected to be such that it pumps coolant at a rate slightly greater than the maximum possible requirement of the cooling system. This rate can be approximated using parameters such as the amount of fuel combusted in the engine per unit time and confirmed by empirical results. It is important that the rate at which the pump 226 pumps be higher than the maximum requirement so that during engine operation wherein large amounts of heat are imparted to the coolant in the coolant jacket 208 the maintainance of the desired level of coolant therein will assured.

In order to control the pump 226 a level sensor 230 is disposed in the coolant jacket 208 and arranged to sense the level of coolant falling below the predetermined level H. In this embodiment H is selected to ensure that the engine structure which is subject to high heat flux (viz., the cylinder head, exhaust ports and valves) remains constanty immersed in a depth of liquid coolant sufficient to ensure constant immersion even under heavy load operation when the boiling of the coolant becomes so vigourous as to tend to induce localized dry-outs and cavitation. These phenomena are apt to cause localized overheating which can lead to serious engine damage. Level H is also selected in a manner to define a coolant vapor collection space in the coolant jacket 208 above the surface of the liquid to permit the vapor generated to accumulate and flow without undue restrition toward the vapor discharge port or ports 212 into the vapor manifold 212 and obviate the tendancy for large volumes of liquid coolant to be "blow out" of the coolant jacket 108.

The level sensor 230 may take the form of a float and reed switch combination. It is deemed advantageous to arrange the level sensor 230 to output a signal when the coolant level is above H. With this, if the sensor 230 fails the pump will be continously energized ensuring that excess coolant rather than the reverse is supplied into the coolant jacket 208.

The vapor manifold 212 in this embodiment is formed with a vent conduit 232. A normally closed electromagnetic valve 234 is disposed in this conduit 232 and arranged to open and permit fluid communication between the interior of the coolant jacket 208 and the ambient atmosphere, when energized. It is also possible to construct this valve so that the bias of the spring which holds the valve element in its closed position can be overcome by abnormally high pressures within the coolant jacket and associated elements and thus also function as a saftey relief valve.

The vapor manifold is also provided with a liquid/vapor separator arrangement 236 which is located downstream of the vapor discharge port 212. A return conduit 238 leads from the bottom of the separator to a port 239 formed in the cylinder block proximate port 229. In this embodiment the separator 236 is shown to comprise a simple sump-like collection recess in the bottom wall of the vapor manifold 212. However, as will be appreciated this device may include baffles or the like to improve the separation efficienty and/or take the form of arrangements disclosed in U.S. Pat. No. 4,499,866 issued on Feb. 19, 1985 in the name of Hirano; U.S. Pat. No. 4,570,579 issued on Feb. 18, 1986 in the name of Hirano; copending U.S. patent application Ser. No. 757,537 filed on July 3, 1985 in the name of Hayashi et al now U.S. Pat. No. 4,636,942; and copending U.S. patent application Ser. No. 866,259 filed on May 23, 1986 in the name of Shimonosono now U.S. Pat. No. 4,664,072. The content of these references is hereby incorporated by reference thereto. These documents disclose arrangements which separate liquid coolant from coolant vapor by subjecting the effluent from the coolant jacket to a number of changes in direction and/or a kind of centrifugal separation.

The provision of the liquid/vapor separator 236 minimizes the amount of liquid coolant which is permitted to flow through the vapor transfer conduit 214 and find its way into the radiator 216. During high speed/high load engine operation, for example, a relatively large amount of fuel is fed to and combusted in the combustion chambers of the engine. This produces a large amount of heat which induces extremely vigorous boiling in and around the cylinder head of the engine. The bumping and frothing which accompanies this vigourous boiling tends to induce the discharge of a relatively large amount of liquid coolant into the vapor manifold 212. The liquid coolant, if permitted to enter the upper tank 219 of the radiator 216, tends to wet and thus insulate the interior of the conduits 221 to the point whereat the "dry" surface area available for the coolant vapor to release its latent heat of evaporation is drastically reduced and the heat exchange capacity of the radiator is adversely effected inducing the possibility of engine overheat due to the inability to release sufficiently large amounts of heat.

A (first) temperature sensor 240 is disposed in the lower tank 220 and arranged to sense the temperature of the coolant which has collected therein. In this embodiment the output of this sensor alone is used to control the operation of fan 218. In this instance the sensor is arranged to induce energization of the fan upon the temperature of the coolant in the lower tank 220 exceeding a value which is selected to fall in the range of 90° to 100° C. Viz., under actual operation the temperature or the condensate in the lower tank approximates the temperature at which the coolant vapor enters the upper tank 219.

A (second) temperature sensor 244 is disposed in the coolant jacket 208 proximate the most highly heated engine structure and arranged to be immersed in the liquid coolant. With this arrangement the immersion of the sensor 244 in liquid coolant stablizes the output thereof ensuring error free operation even when the coolant is boiling and bumping vigourously. In the event of an excessive lack of coolant in the cooling jacket 208 which permits the sensor to be directly exposed to heat radiation from the structure of the cylinder head 206 or the like, the resulting abnormally high temperature signal can be used to indicate a malfunction.

The output of temperature sensor 244 is used to control the energization of valve 234. In this embodiment the temperature sensor 244 is arranged to issue a signal which energizes and opens the valve 234 when the temperature of the coolant jacket is at or below 45° C. (by way of example). Viz., a temperature which is indicative of the engine 200 being "cold" and not having been used in the just immediate past and at which the coolant jacket 208, radiator 211 will inevitably be filled with liquid coolant.

A vehicle cabin heating arrangement comprises a heater core 246 a induction conduit 248, a discharge conduit 250 and a circulation pump 252 disposed in the discharge conduit. The induction conduit 248 is arranged to communicate with a section of the coolant jacket 208 formed in the cylinder block 208 while the dischage conduit 250 communicates with a section of the coolant jacket 208 which is formed in the cylinder head 206. The discharge conduit 250 is arranged to discharge coolant which has passed through the heater core 246 into the coolant jacket 208 at level which lower than the above mentioned level H.

The operation of the circulation pump 252 is controlled in accordance with a manually operable switch (not shown).

It will be noted that it is possible to reverse the arrangement of the induction and discharge conduits 248, 250 and arrange for the induction conduit 248 to communicate with the coolant jacket 208 at a level higher than level H so as to enable the circulation of coolant vapor through the heater core 246 and thus take advantage of the large amount of heat (latent heat of evaporation) contained therein.

The operation of the first emboidment is such that when the engine 200 is stopped and cools the coolant vapor which fills the upper sections of the coolant jacket 208, radiator 216, vapor manifold and vapor transfer conduit 212, 214 condenses and induces a negative pressure which inducts coolant from the reservoir 224 via conduit 228 until the coolant jacket 208 vapor manifold 212, radiator 216 and associated conduiting are completely filled with coolant or the pressure differential between the coolant jacket 208 (for example) and the ambient atmosphere becomes zero. During this process, the fan 218 is subject to the control of the temperature sensor 240.

If the engine 200 is subject to a restart with the coolant in the coolant jacket 208 above the level at which temperature sensor 244 is permitted to energize and open valve 234, said valve is left closed and the coolant in the coolant jacket 208 displaced under the influence of the vapor pressure which develops in the coolant jacket and the coolant becomes heated. It will be noted that if the level of liquid coolant is above H no circulation of the same takes place and the stagnant coolant located in and around the highly heated structure of the engine cylinder head 206 quickly produces vapor and begins to boil.

Upon the temperature of the coolant in the lower tank 220 reaching the given level the cooling fan 218 is energized. If the rate of condensation induced by the fan 218 and or by the influence of environmental ambient effects such as natural drafts, low temperatures etc., is such as to exceed the rate at which coolant vapor is being produced, the pressure in the system drops below atmospheric and inducts coolant fromthe reservoir 224 into the lower tank 220 via conduit 228 in a manner which decreases the temperature prevailing in the lower tank and which increases the level of liquid in the conduits 221. This reduces the amount of "dry" surface area available for the latent heat of the coolant vapor to be released, stops the operation of the fan 218 and induces the situation wherein the rate of condensation is automatically matched with the rate of vapor generation.

Upon engine start up, electrical energy is supplied to the circiut including the temperature sensor 244, electromagnetic valve 234, level sensor 230 and coolant return pump 226. It will be noted that the circuit including the temperature sensor 240 and the fan 218 are not circuited with the engine ignition switch so as to enable the cool-down or "shut-down" mode which is executed after the engine is stopped.

If at this time the temperature sensor 244 outputs a signal indicative of the engine being "cold" (viz., outputs a high level voltage signal) then a "quick warm-up" mode is entered.

During this mode, the electromagnetic valve 234 is opened and atmospheric air temporarily allowed into the system via vent conduit 232. This allows the coolant which is filling the coolant jacket 208 etc., to drain rapidly into the reservoir 224 until the levels become equal such as shown in FIG. 7 for example). By arranging the reservoir 224 at an appropriate level as mentioned hereinbefore, and ensuring that an appropriate amount of coolant is contained in the latter, then is an easy matter to simply allow the levels to simply equalize at level H.

However, in the event that the reservoir 224 is not located as illustrated (viz., is located at a lower level) and or there is the possibility that the reservoir 224 may not always be appropriately filled with liquid coolant, then it is within the scope of the invention as a variant the first embodiment to tap the output of level sensor 230 and terminate the energization of valve 234 when this sensor indicates that the level of coolant has dropped to H.

Under these conditions as the amount of coolant in the coolant jacket 208 has been notably reduced the amount of heat which is required to bring the remaining coolant to the point of generating coolant vapor and boiling is reduced promoting very rapid system warm-up.

As the amount of coolant vapor increases the air which has been admitted to the interior of the coolant jacket 208 etc., is gradually displaced toward and down through the radiator 216 and eventually is discharged into the reservoir 224 wherein it bubbles up through the coolant contained therein and is released to the atmosphere via vent 234. Simultanenously, under the control of level sensor 230 the coolant return pump 226 replenishes the evaporated coolant in a manner that maintains the liquid level in the coolant jacket at level H.

While any air remains in the system the heat efficiency of the radiator 216 is usually impaired thus causing a pressure build-up which hastens the purging of the non-condensible matter. Viz., the thermally insulating air forms pockets in the radiator conduiting 221 which prevents the coolant vapor from releasing its latent heat and thus tends to be pushed toward the bottom of the radiator by the lighter and hotter coolant vapor which is constantly being generated in the coolant jacket 208.

Figure 8:
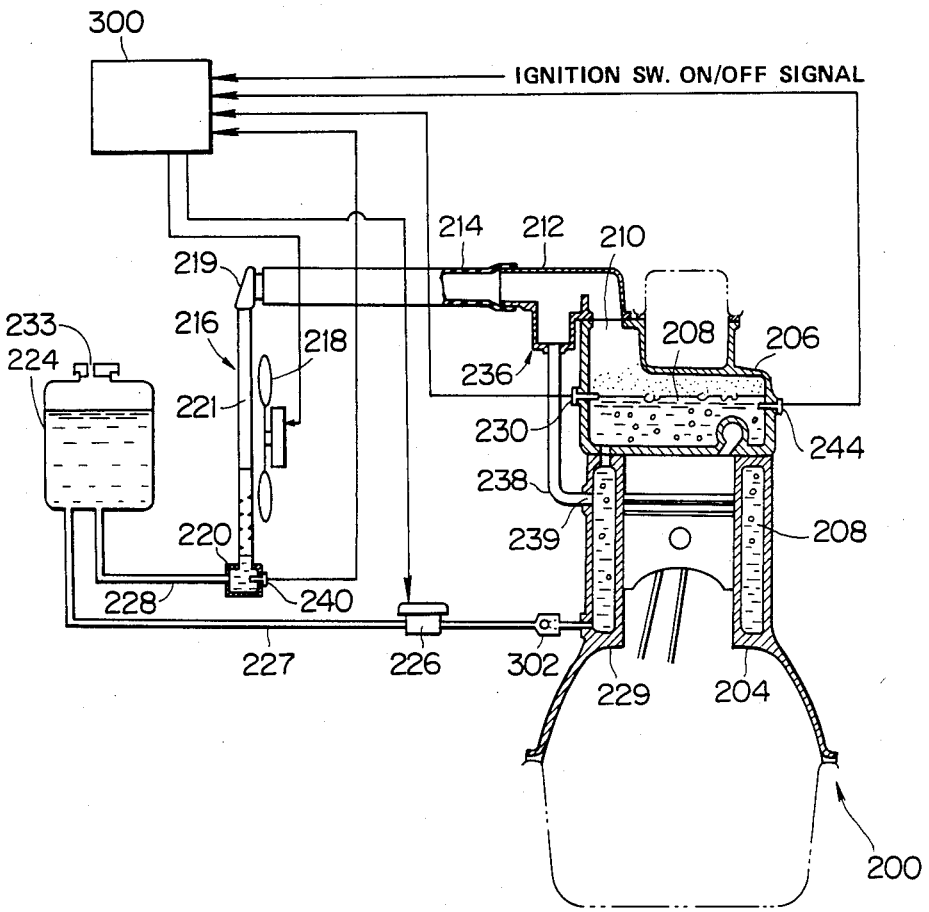
Figure 10:
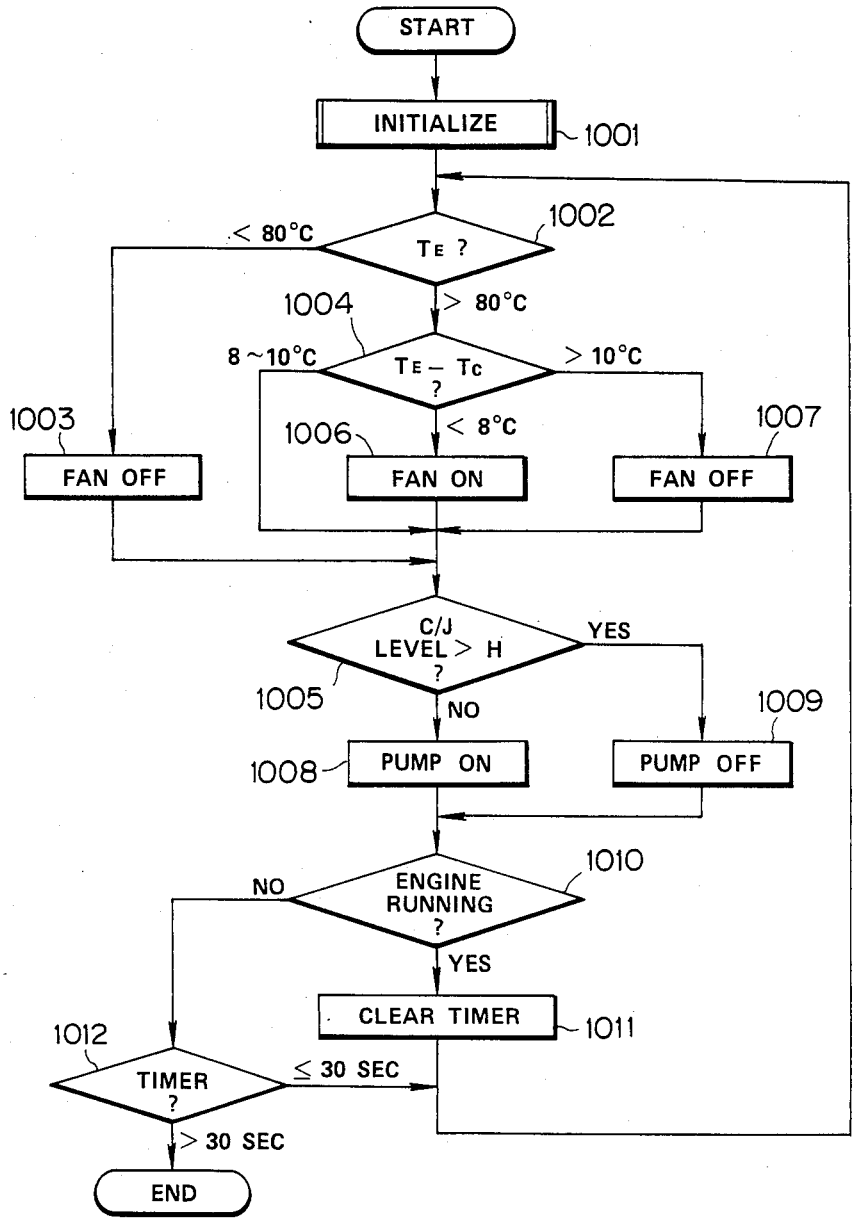
FIG. 10 is a flow chart showing the steps which characterize the control of the second embodiment of the present invention.

FIGS. 8 and 10 pertain to a second embodiment of the present invention. In this arrangement in order to avoid wasteful energization of the fan under the conditions wherein the radiator is at least partially filled with liquid coolant, (viz., a condition when little surface area is available for latent heat release) the output of the second temperature sensor 244 is used in combination with the first one 240 in a manner to derive a temperature differential which is indicative of the amount of liquid coolant contained in the heat exchanging section of the radiator and thus enable a decision as to whether it is useful to operate the fan 218 or not.

The amount of condensation which occurs in the radiator 216 is subject to not only the operation of the fan 218 but to external influences as well. For example, when only the lower tank temperature sensor 240 is provided it is necessary to set the temperature at which the fan operated in a range of 80°-85° C. (when ethylene glycol anti-freeze/water is used as the engine coolant - it being noted that this solution boils at about 105° C. at sea level) to allow for the situations wherein the vehicle is operated at high altitudes (e.g. mountainous areas) and the atmospheric pressure is lower than at sea level. This induces the problem that as sea level the fan is apt to excessively energized increasing the amount of electrical energy that is consumed (uncessarily) and cause the generation of annoying fan noise.

With the second emboidment as the boiling point of the coolant varies with the atmospheric pressure (it being noted that in the system to which the second embodiment is applied the reservoir vent is un-controlled and thus maintains the pressure within the cooling system essentially at atmospheric level) if the fan is operated in response to the temperature differential which prevails between the coolant jacket and the radiator lower tank 220 an economic control of the fan 218 is rendered possible. For example, if the vehicle is coasting downhill on a cool day, the amount of fuel being combusted is relatively small and the natural draft of air passing over the radiator relatively strong, the rate of condensation within the radiator increases above that at which vapor is being generated, the pressure drops, coolant is inducted via conduit 228 into the lower tank and conduiting 221 and the temperature in the lower tank drops with respect to the temperature prevailing in the coolant jacket irrespective of the atitude and the actual boiling point of the coolant. Under these conditions it is not necesary to operate the cooling fan 218. In fact experiments have shown that when the radiator 208 is partially filled, fan energization produces only a very small increase in heat exchange between the atmosphere and the radiator.

Accordingly, the relatively large temperature differential which naturally develops between the coolant jacket 208 and the lower tank 220 at this time can be used to indicate that fan operation is not required and thus be used to inhibit wasteful energization. Further, under these conditions the level of liquid coolant in the radiator conduiting 221 tends to rise in repsonse to the high rate of condensation which is induced by the ambient conditions and "automatically" reduce the "dry" area available for latent heat release to the appropriate degree.

On the other hand, if the vehicle is operating in slow moving bumper to bumper heavy traffic on a hot day (for example) the natural draft of air passing over the conduits 221 of the radiator 216 can be all but non-existent. Under these conditions the temperature in th lower tank 220 gradually approaches the temperature at which the coolant vapor is introduce into the upper tank 219. Viz., the radiator 216 tends to fill with uncondensed hot coolant vapor. This causes the temperature of the liquid coolant in the lower tank 220 to rise toward that prevailing in the coolant jacket 208 and reduces the value of the temperature differential therebetween. Energization of the fan 218 under such conditions increases the rate of condensation within the radiator 216. By maintaining the energization until the temperature differential increase to a given valve the rate of condensation can be matched with the rate of vapor generation, prevent the situation wherein coolant vapor escapes to the reservoir 224 and maintains the required control of the system.

FIG. 10 shows in flow chart form the steps which are executed in a microprocessor (not shown) included in a control circuit 300 to which the outputs of level sensor 230 and temperature sensors 240, 244 are fed.

Following the intialization of the system the output of temperature sensor 244 is sampled and ranged in step 1002.

In this embodiment if the temperature of the liquid in the coolant jacket is found at step 1002 to be less than a predetermined level (80° C. for example) the operaton of the fan is inhibited (step 1003). Under these conditions the coolant will normally not be boiling even if the vehicle has ascended a high mountain. At step 1004 the temperature differential which exists between the coolant jacket and the lower tank is ranged.

In this and subsequent flow charts the temprature prevailing in the coolant jacket is denoted by TE (engine temp) while the temperature prevailing in the radiator is denoted by TC (condensor temp).

In the event that the differential is within 8°-10° C. then th program flows directly to step 1005, while in the event that the differential is less than 8° C. at step 1006 a command to energize fan 218 is issued. In the event that the temperature differential is greater than 10° C. then the operation of the fan 218 is stopped (step 1007).

At steps 1005 to 1009 the output of level sensor 230 is sampled and the appropriate pump control implemented to ensure that the level of coolant does not fall below level H.

At step 1010 the status of the engine is determined. Viz., it is determined if the engine is running or not. This can be determined by sampling the output of a engine speed sensor or the engine distibutor and determing if the engine speed is above or below a given low value—for example 100 RPM. If the engine is found to be running then the program flows to step 1011 wherein a timer (a soft clock by way of example) is cleared whereafter it recycles to step 1002. By way of example the timer can be set up to count up by 1 each run of the program and to be reset to zero or some predetermined value whenever step 1011 is implemented.

However, if at step 1010 the engine is found to have stopped then at step 1012 the current count of the timer is sampled and if the count has exceeded a value indicative of 30 seconds (for example) the program ends terminating the control of the system and cutting off the supply of power to the fan 218 and other circuitry.

On the other hand, if the engine has not been stopped for at least 30 seconds then the program recycles. This ensures that the system will reamain operative for a short period of time after the engine is stopped so as to allow for the heat which has accumulated in the engine structure etc., to be released sufficiently to the atmosphere and allow for the thermal inertia which will keep the coolant boiling and possibly generate undesirably high pressures within the system.

In the cooling system to which the second embodiment of the present invention is applied a one-way check valve 302 is disposed in the coolant return conduit 227 at a location intermediate of the coolant return pump 226 and port 229. This provision prevents coolant from draining back through the coolant return conduit toward the reservoir 224 in the event that the pump 226 is not of a construction which inherently inhibits such a reverse flow.

Figure 9:
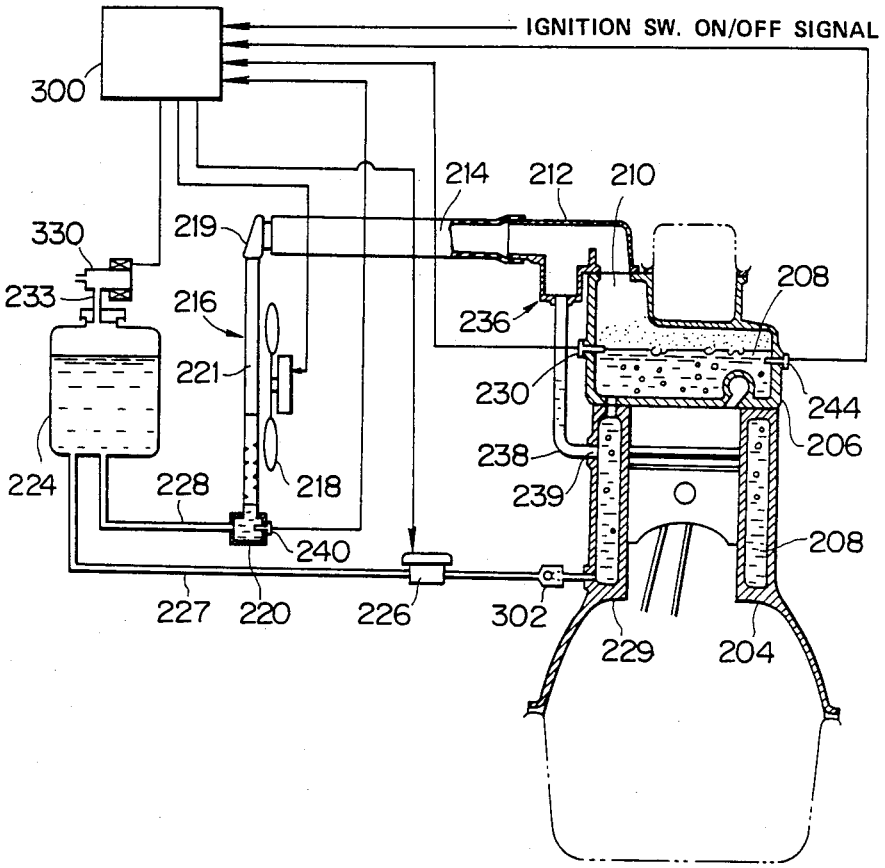
Figure 11:
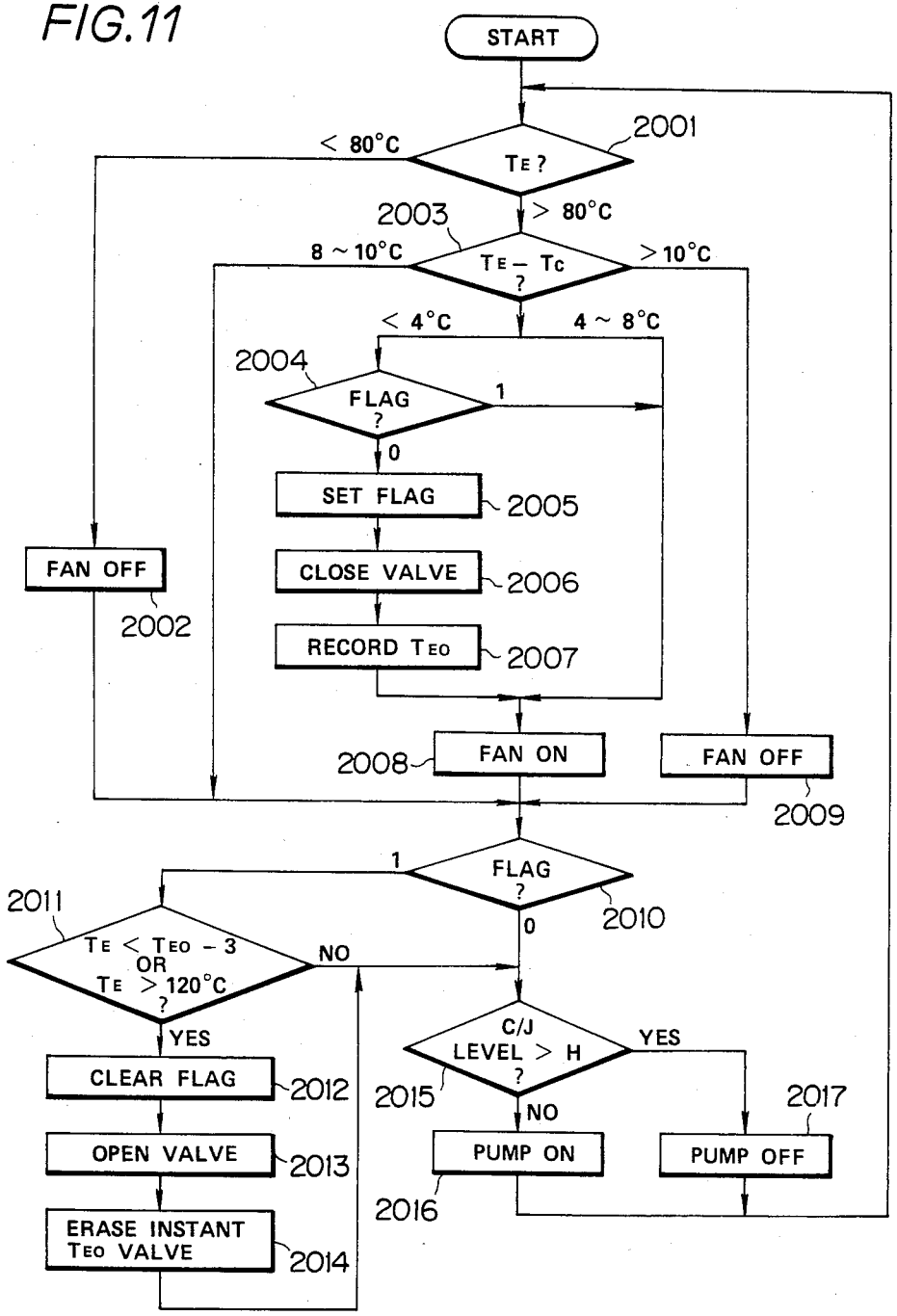
FIGS. 11 and 12 are flow charts showing the steps executed during the operation of the third embodiment.
Figure 12:
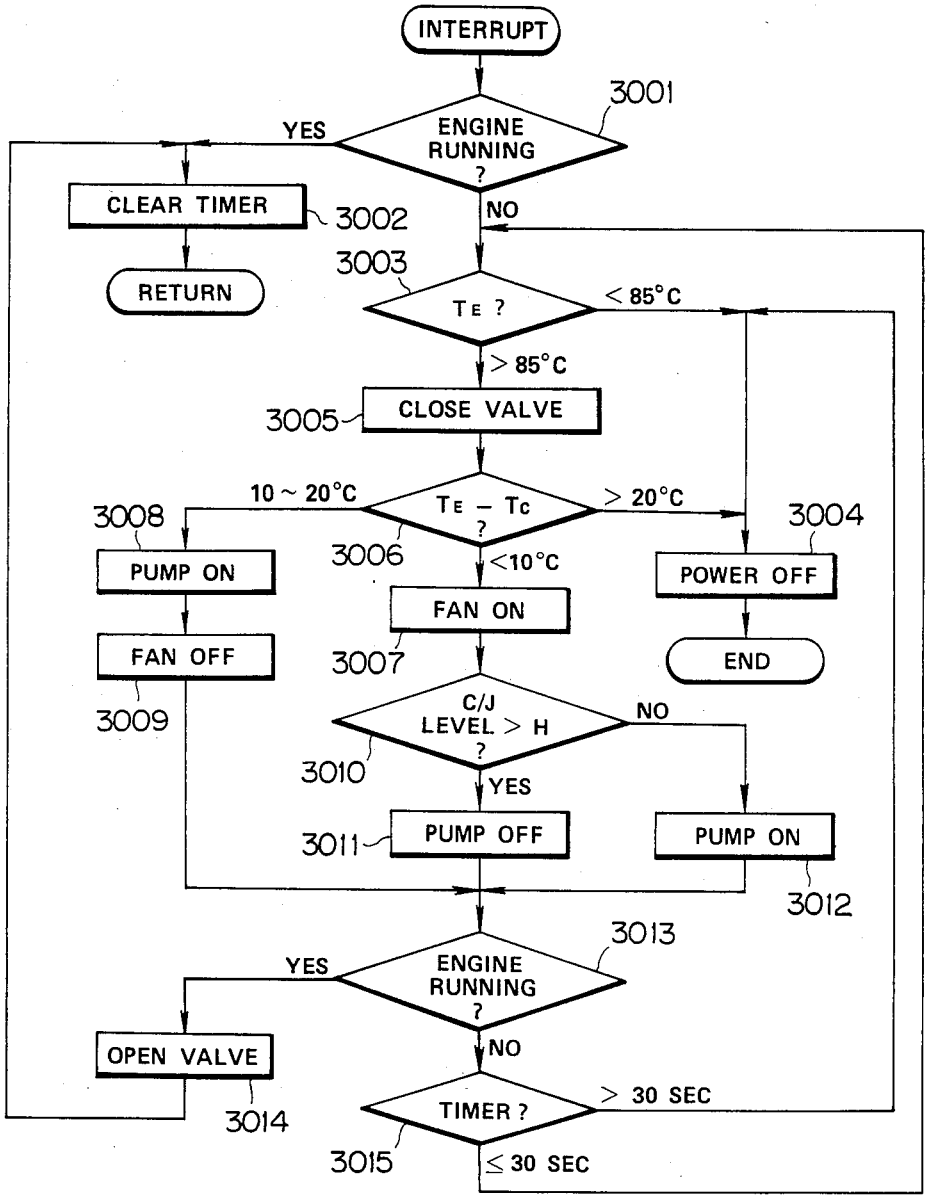

FIGS. 9, 11 and 12 pertain to a third embodiment of the present invention. The cooling system to which the third embodiment is applied features a construction essentially the same as that of the second embodiment save the provision of a normally open electromagnetic valve 330 which is arranged to selectively energizable to close the reservoir vent 234. The provision of this valve enables the pressure and temperature in the radiator 216 and coolant jacket 208 to be selectively raised in a manner which prevents the loss of coolant vapor and increases the temperature differential which exists between the interior of radiator and that of the cooling medium (in this case atmospheric air) in contact with the exterior thereof.

It sometimes occurs that due to operation at high altitudes the temperature differential between the interior of the radiator and the ambient atmosphere lowers due to the reduced boiling point of the engine coolant. This reduces the heat exchange efficiency of the radiator 216 and in some cases induces the situation wherein heat release ability thereof falls below the rate at which heat is being imparted to the coolant contained in the coolant jacket 208. Alternatively, if the engine is operated at extremely high load/high speed for a prolonged period it sometimes occurs in hot environments that a similar inability to release all of the heat imparted to the engine coolant occurs.

One solution to this problem is to increase the size of the radiator, however this increases the cost and weight of the system. The instant emodiment solves this problem by selectively sealing the system in a manner which raises the temperature and pressure in the radiator, increases the boiling point of the coolant, the temperature differential between the interior of the radiator 216 and the ambient atmosphere and therefore increases the heat exchange ability of the device.

The same technique is applied when the engine is stopped and the system enters the so called "shut-down" mode wherein the heat accumulated in the engine is released via the cooling system for a short period following engine stoppage.

FIGS. 11 and 12 show in flow chart form the steps which are performed by a microprocessor included in the control circuit 300 in accordance with the third embodiment.

As shown, following the start of the system control routine (FIG. 11) the output of temperature sensor 244 is sampled in step 2001 and the determination made as to whether the temperature prevailing in the coolant jacket 208 is above or below a given level which in this case is selected to be 80° C. If the coolant is found to be "cold" then the program flows to step 202 wherein a command to stop the opration of fan 218 is issued. As will be appreciated is the coolant is "cold" there is clearly no need to operate the fan irrespective of the temperature differential between the coolant jacket and the radiator as both are apt to be completely or nearly filled with liquid.

On the other hand, if the coolant temperature is above 80° C. then at step 2003 the outputs of temperature sensors 244 and 240 are compared and the differential ranged. If the ranging reveals that the temperature differential is (a) between 8 and 10 degrees things are left as they are and the program flows to step 2010; (b) greater than 10° C. then at step 2009 the fan operation is inhibited; (c) beteeen 4° and 8° C. then at step 2008 a command to energize fan 218 is issued; and (d) if less than 4° C. then as step 2004 the status of FLAG is determined. If the flag is found to be "1" then the program flows to step 2008. However, if the value of the flag is found to be "0" then the program flows to step 2005. In steps 2005 and 2006 the value of the flag is set to "1" and a command to close valve 330 via energization is issued. In this routine, flag "0" is used to indicate that valve 330 is open while the valve "1" denotes a closed or energized condition.

At step 2007 the value of TEO the coolant jacket temperature at which valve 330 was closed is recorded in RAM and at step 2008 a command to energize fan 218 is issued.

At step 2010 the instant status of FLAG is determined. If the value is "1" indicating that valve 330 is closed, then at step 2011 the recorded value of TEO minus 3° C. is compared with the instant output of temperature sensor 244 and the latter compared with a maximum permissible value of 120° C.

If the outcome of this enquiry indicates that the instant coolant jacket temperature is less than TEO—3° C. or greater than 120° C. then at steps 2012 to 2014 the instant value of FLAG is cleared, a command to open valve 330 is issued and the instant value of TEO is erased from RAM (valve 330 having just been reopened).

These steps ensure that in the event that the coolant jacket temperature has dropped by a given amount as compared with the temperature at which valve 330 was closed, that the reservoir can be again vented to the atmosphere as the temporary closure of valve 330 has proven effective in overcomming the momentary inability of the radiator to release as much heat as is being imparted to the coolant in the coolant jacket; or alternatively vent excessive pressure from the system in the case that momentary closure has not been effective and the system is in danger of overheating.

Following either a negative outcome at step 2011 or subsequent to step 2014, steps 2015 to 2017 are executed in order to ensure that the level of liquid coolant in the coolant jacket 208 is prevented from falling below level H and the program recycles to step 2001.

FIG. 12 shows in flow chart form the steps which are performed as an interrupt program in order to determine the instant status of the engine. Viz., determine whether the engine is running or not and whether it is necessary to execute the steps of a "shut-down" program. This interrupt is performed at predetermined frequent intervals.

The first step of this program is such as to sample the output of device such as the ignition inition key, an engine speed sensor of ignition system and determine if the engine is still running or has stopped. In the event that the engine is still operating then the program flows to step 3002 wherein the current count of a soft clock or timer is cleared and the program returns to that shown in FIG. 11.

However, if the engine is not running then the program proceeds into the shut-down control section thereof. At step 3003 the coolant jacket temperature is determined and ranged against a predetermined value of 85° C. In the event that this enquiry reveals that the engine coolant is cold (below 85° C.) then at step 3004 the power to the system is cut-off. On the other hand, if the coolant is not "cold" then at step 3005 valve 330 is energized so as to assume a closed state and close off the radiator 216 from the ambient atmosphere. This now conditions the system so that the temperature and pressure in the radiator can be selectively elevated to increase the heat exchange ability of the same and thus speed up the final cooling of the engine.

At step 3006 the temperature differential between the coolant jacket coolant and the condensate in the lower tank 220 of the radiator 216 is determined. If the differential is greater than 20° C. then the program flows to step, if less than 10° C. at step 3007 fan 218 is energized while if within a range of 10° to 20° C. at steps 3008 and 3009 commands to energize the coolant return pump 226 and de-energize fan 218 are issued.

In the event that the temperature differential is relatively high it can be assumed that the radiator 216 is at least partially filled with the liquid coolant and that the chances of vapor loss to the atmosphere are negligible. However, if the differential is low then is may be assumed that the radiator 216 still contains a relatively large amount of colant vapor and that the energization of the fan will have the desired effect on the rate of condensation. On the other hand if the temperature is within a predetermined range of 10°–20° C. then it can be assumed that the most practical course of cooling the engine is to pump cool coolant from the reservoir 224 into the coolant jacket 208. As valve 330 is closed at this time this pumping operation causes a slightly negative pressure to develop in the reservoir 224 which in turn inducts coolant from the lower tank 220 thereinto. This tend to fill the coolant jacket 208 and drain the radiator 216 in a manner which increases the amount of gaseous coolant in the latter and thus increases the effectiveness of fan energization. Viz., pushes the remaining coolant vapor out of the coolant jacket 208 in the direction the radiator 216. Should any coolant vapor be extracted from the radiator under such conditions the vapor upon encountering the cool coolant in the reservoir 224 quickly condenses.

Steps 3007 steps 3010 to 3012 are such as to ensure that the post engine operation boiling does not accidently lower the liquid coolant level to the point that thermal damage to the same can occur.

At step 3013 it is again determined if the engine is running or not. If the engine is found to be running then at step 3014 valve 330 is opened and the program returns via step 3002. On the other hand, if this enquiry confirms that the engine is not running then at step 3015 the count of the timer is sampled to determine if the engine has been stopped for at least 30 seconds. Until the count amounts to this value then the program recycles to step 3003.

Figure 13:
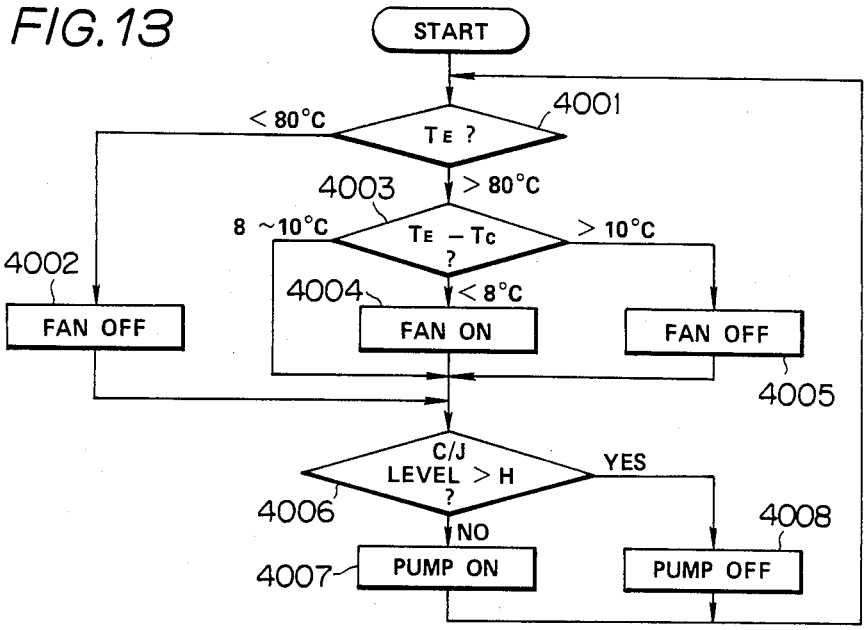
FIGS. 13 and 14 are flow charts depicting the control which characterizes the operation of the fourth embodiment of the present invention.
Figure 14:
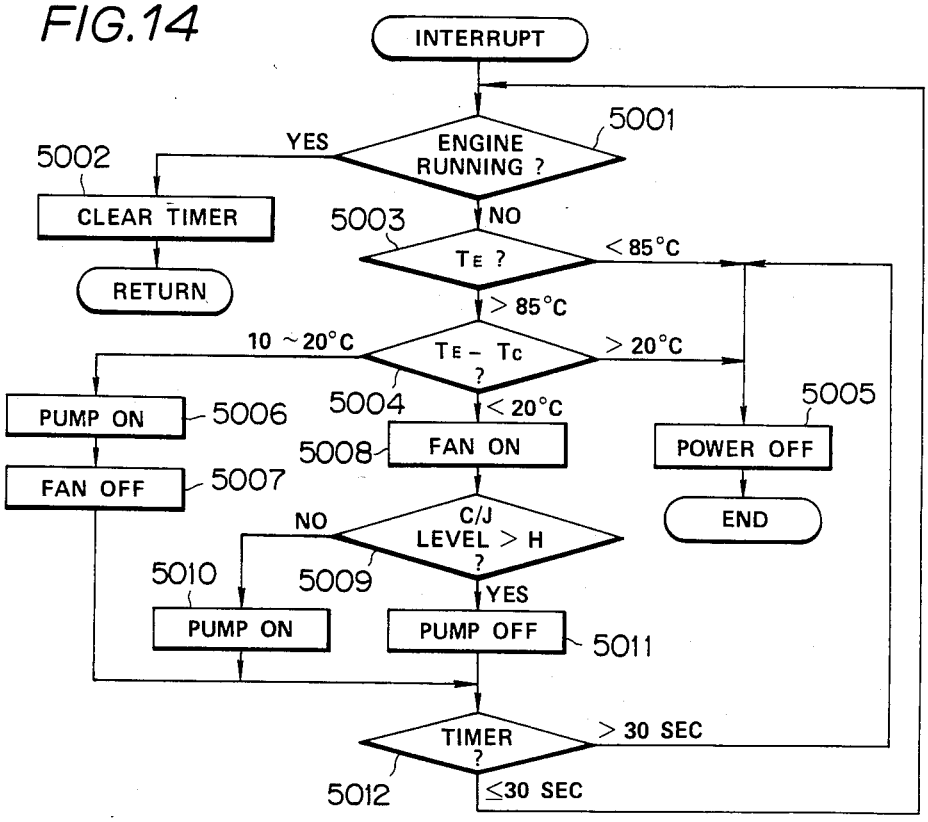

FIGS. 8, 13 and 14 pertain to a fourth embodiment of the present invention. This embodiment is essentially the same as the third one save that it does not require the provision of the electromagnetic valve 330. In this embodiment while the engine is operating the fan 218 is used to control the temperature of the coolant in the coolant jacket 208 while in the event that the engine is stopped both the fan 218 and the coolant return pump 226 are selectively operated. Thus, other than selectively increasing the temperature and pressure within the radiator by sealing off the communication between the interior of the reservoir 224 from the ambient atmosphere via the use of valve 330 the operation of the fourth embodiment is similar to that of the third one.

FIG. 13 shows the steps which characterize the control executed by a system control routine according to to the fourth embodiment. FIG. 14 shows the interrupt routine which is run a predetermined time intervals in order to determine the need to implement "shut-down" control.

Figure 15:
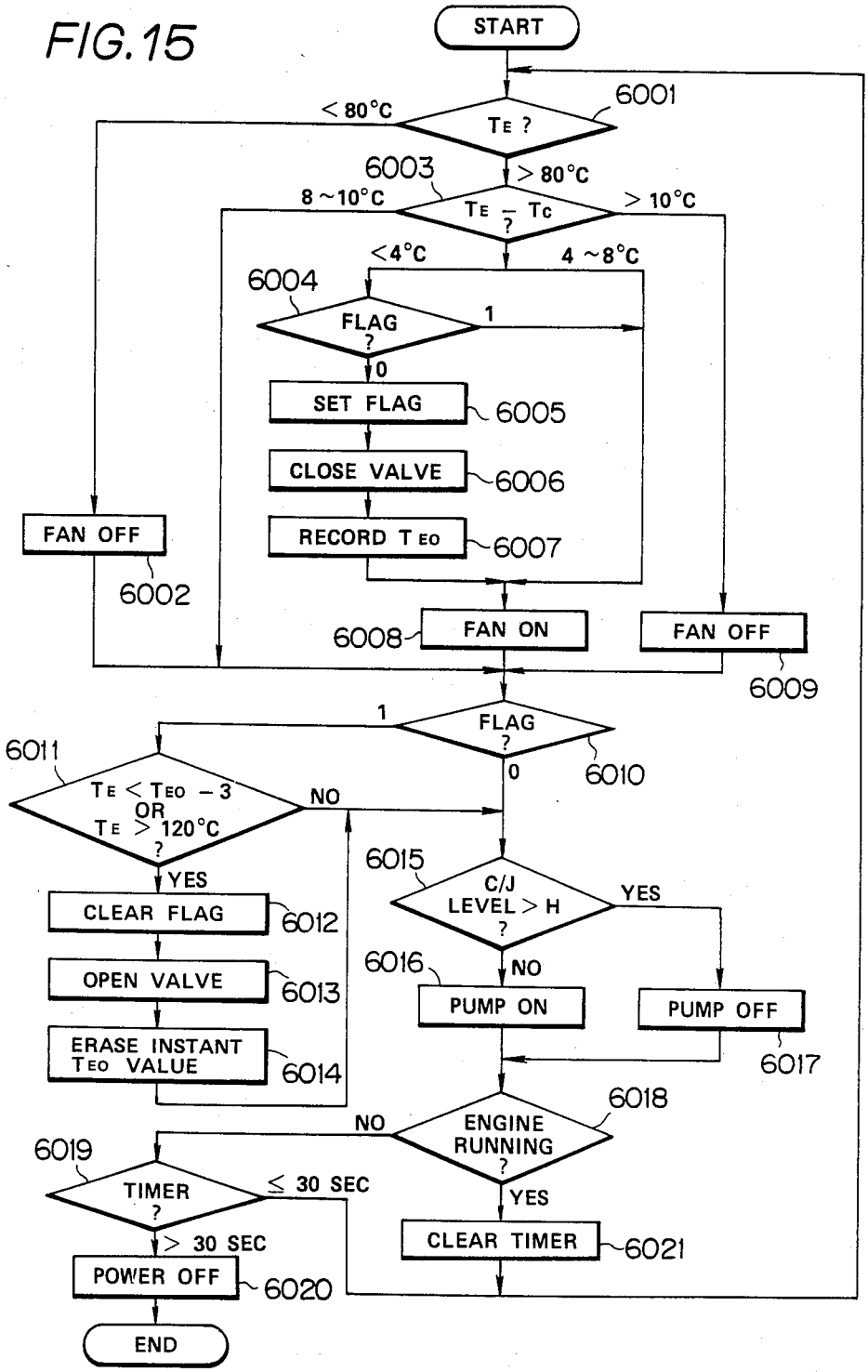
FIG. 15 is a flow chart which shows the control steps executed during the operation of the fifth embodiment of the present invention.

FIGS. 9 and 15 pertain to a fifth embodiment of the present invention. This embodiment is basically similar to the third one save that the system control routine includes the steps executed in the interrupt routine of the third embodiment. The operation and effect this embodiment will be clear from the disclosure relating to the third embodiment given hereinbefore. Further redundant disclosure will be omitted for brevity.

It will be noted that it is possible to combine the embodiments of the present invention to form a single system if so desired. This would mean the provision of two electromagnetic valve in the most complicated case. Viz., one to control a coolant jacket vent and the other to control the reservoir vent.

What is claimed is:

1. In an internal combustion engine having a structure subject to high heat flux a cooling system comprising:

a coolant jacket disposed about said structure and into which coolant is introduced in liquid form and discharged in gaseous form;

a radiator in fluid commuication with said coolant jacket which receives coolant vapor produced therein and condenses it to its liquid form, said radiator including a small collection vessel disposed at the bottom thereof;

a reservoir in which coolant is stored, said reservoir being fluidly interposed between the collection vessel of said radiator and said coolant jacket;

a level sensor disposed in said coolant jacket, said level sensor being arrange to sense the level of liquid coolant in said coolant jacket falling below a predetermined level and issues a signal indicative thereof, said predetermined level being selected to be such that said structure subject to high heat flux is immersed in a predetermined depth of liquid coolant;

a pump which pumps liquid coolant from said reservoir to said coolant jacket through a coolant return conduit, said pump being responsive to said level sensor in a manner to maintain the level of liquid in said coolant jacket at said predetermined level;

a first temperature sensor disposed in said radiator;

a second temperature sensor disposed in said coolant jacket; and a device associated with one of said radiator, said coolant jacket and said reservoir, said device being responsive to one at least one of said first and second temperature sensors for controlling the pressure within the cooling system.

2. An internal combustion engine as claimed in claim 1, wherein said device takes the form of an fan which when energized increases the heat exchange between said radiator and a cooling medium surrounding said radiator.

3. An internal combustion engine as claimed in claim 2, wherein said fan is responsive to said first temperature sensor and arranged to be energized when said first temperature sensor indicates that the temperature of the coolant in said lower tank is above a first predetermined value.

4. An internal combustion engine as claimed in claim 2, wherein said fan is reponsive to both said first and second sensors and arranged to assume a non-energized state when said first and second temperature sensors indicate that the temperature differential between said coolant jacket and said lower tank is greater than a second predetermined value.

5. An internal combustion engine as claimed in claim 1, further comprising:

a coolant jacket vent, said coolant jacket vent establishing fluid communication between said coolant jacket and the ambient atmosphere; and wherein said device comprises a coolant jacket vent control valve disposed in said coolant jacket vent, said coolant jacket vent control valve being responsive to said second temperature sensor in a manner to open said coolant jacket vent when the engine is running and the temperature of the coolant in said coolant jacket is sensed as being below a third predetermined level.

6. An internal combustion engine as claimed in claim 5, wherein said reservoir is arranged with respect to said coolant jacket so that when said coolant jacket vent valve is opened the level of the coolant in said coolant jacket and the level of the coolant in said reservoir an equaize at a level essentially equal to said predetermined level.

7. An internal combustion engine as claimed in claim 1, further comprising a reservoir vent, said reservoir vent being arranged to intercommunicate said rservoir with the ambient atmosphere.

8. An internal combustion engine as claimed in claim 7, wherein said device takes the form of a reservoir vent control valve which is responsive to said first and second temperature sensors for closing said reservoir vent valve when said first and second temperature sensors indicate that the temperature differential between the coolant jacket and the lower tank is less than a fourth predetermined value.

9. An internal combustion engine as claimed in claim 1, further comprising one-way check valve means for preventing coolant from flowing from said coolant jacket to said reservoir via the coolant return conduit.

10. An internal combustion engine as claimed in claim 1, further comprising a separator for separating liquid coolant from the coolant vapor which is discharged from said coolant jacket and returning said liquid coolant to said coolant jacket and permitting the coolant vapor to flow to said radiator for condensation therein.

11. An internal combustion engine as claimed in claim 10, wherein said separator comprises:

a trap located downstream of a vapor discharge port associted with said coolant jacket, and a conduit leading from said trap to a section of said coolant jacket which is lower than and remote from the discharge port.

12. In a method of cooling a internal combustion engine the steps of:

introducing liquid coolant into a coolant jacket, permitting the coolant to boil and discharging the coolant in vaporized form;

condensing the coolant vapor discharged from said coolant jacket in a radiator to form a condensate;

storing liquid coolant in a reservoir;

returning the condensate formed in said radiator to said reservoir;

sensing the level of coolant in said coolant jacket using a level sensor;

pumping liquid coolant from said reservoir to said coolant jacket in response to the level sensing step indicating that the level of liquid coolant in the coolant jacket is below a predetermined level;

sensing the temperature of the condensate formed in said radiator;

sensing the temperature of the coolant in said coolant jacket; and controlling a device associated with one of the radiator, the coolant jacket and the reservoir in a manner which controls the pressure prevailing within the cooling system.

13. A method as claimed in claim 12, wherein said step of controlling includes the step of: controlling a fan which increases the heat exchange between the radiator and a cooling medium surrounding the radiator.

14. A method as claimed in claim 13, wherein said step of controlling includes the step of: energizing said fan in response to said step of sensing the temperature of the condensate in said radiator indicating that the temperature of the condensate is above a first predetermined value.

15. A method as claimed in claim 12, wherein said step of controlling includes the steps of:

determining the value of the temperature differential which exists between the condensate formed in said radiator and the coolant in said coolant jacket; and energizing said fan in response to the value of the temperature differential being greater than a second predetermined value.

16. A method as claimed in claim 12, further comprising the step of: selectively venting the coolant jacket to the ambient atmosphere when the engine is running and said step of sensing the temperature of the coolant in said coolant jacket indicates that the temperature is below a third predetermined level.

17. A method as claimed in claim 16, further comprising the step of arranging said reservoir at a level with respect to said coolant jacket so that when said step of venting the coolant jacket to the ambient atmosphere is effected the liquid coolant in the reservoir and in said coolant jacket can assume a common level which is essentially equal to said predetermined level.

18. A method as claimed in claim 16, further comprising the steps of:

arranging said reservoir at a level with respect to said coolant jacket so that when said step of venting is effected the liquid coolant in said coolant jacket can drain into said reservoir; and terminating the venting upon the level of coolant in said coolant jacket falling said predermined level.

19. A method as claimed in claim 12, further comprising the steps of:

venting the reservoir to the ambient atmosphere.

20. A method as claimed in claim 19, further comprising the step of: closing said reservoir vent in response to the temperature differential between the coolant in coolant jacket and the condensate in said radiator being below a fourth predetermined value.

21. A method as claimed in claim 19, further comprising the step of filling the radiator and coolant jacket with liquid coolant from said reservoir when the engine is not in use using the pressure differential which develops between (a) the coolant jacket and radiator and (b) said reservoir as the coolant vapor in said coolant jacket and said radiator cool and condense to liquid.

22. A method as claimed in claim 12, further comprising the step of preventing coolant from flowing from said coolant jacket to said reservoir via a pump interposed therebetween.

23. A method as claimed in claim 12, further comprising the steps of:

separating the liquid coolant from the coolant vapor contained in the effluent discharged from the coolant jacket at a location between said coolant jacket and said radiator;

returning the liquid coolant obtained via the separation to the coolant jacket; and transmitting the coolant vapor to the radiator for condensation therein.

* * * * *